US008316835B2

(12) United States Patent
Kaakkola et al.

(10) Patent No.: US 8,316,835 B2
(45) Date of Patent: Nov. 27, 2012

(54) ANTI-CHOP EYES FOR A PAINTBALL MARKER

(75) Inventors: Eero Kaakkola, Helsinki (FI); Adam Harrison Thorp, San Diego, CA (US)

(73) Assignee: Dye Precision, Inc., San Diego, CA (US)

( * ) Notice: Subject to any disclaimer, the term of this patent is extended or adjusted under 35 U.S.C. 154(b) by 0 days.

(21) Appl. No.: 12/836,124

(22) Filed: Jul. 14, 2010

(65) Prior Publication Data

US 2010/0275894 A1 Nov. 4, 2010

Related U.S. Application Data

(63) Continuation of application No. 11/540,924, filed on Sep. 28, 2006, now Pat. No. 7,765,998.

(51) Int. Cl.
*F41A 19/58* (2006.01)

(52) U.S. Cl. ..... 124/32; 124/73; 124/71

(58) Field of Classification Search ..... 124/71–77, 124/32

See application file for complete search history.

(56) References Cited

U.S. PATENT DOCUMENTS

| | | | | |
|---|---|---|---|---|
| 2,275,723 | A | 3/1942 | Bregi | |
| 2,881,752 | A | 4/1959 | Blahnik | |
| 3,204,625 | A | 9/1965 | Shepherd | |
| 3,640,263 | A * | 2/1972 | Rhodes | 124/75 |
| 4,227,508 | A | 10/1980 | D'Andrade | |
| 4,369,759 | A | 1/1983 | Gerstenberger et al. | |
| 4,644,930 | A | 2/1987 | Mainhardt | |
| 4,850,330 | A | 7/1989 | Nagayoshi | |
| 4,936,282 | A | 6/1990 | Dobbins et al. | |
| 5,063,905 | A | 11/1991 | Farrell | |
| 5,078,118 | A | 1/1992 | Perrone | |
| 5,253,873 | A | 10/1993 | Grattan | |
| 5,257,614 | A | 11/1993 | Sullivan | |
| 5,265,582 | A | 11/1993 | Bhogal | |
| 5,280,778 | A | 1/1994 | Kotsiopoulos | |
| 5,349,938 | A | 9/1994 | Farrell | |
| 5,383,442 | A | 1/1995 | Tippmann | |
| 5,505,188 | A | 4/1996 | Williams | |
| 5,509,399 | A | 4/1996 | Poor | |
| 5,572,982 | A | 11/1996 | Williams | |
| 5,613,483 | A | 3/1997 | Lukas et al. | |

(Continued)

FOREIGN PATENT DOCUMENTS

EP 1 503 166 A 2/2005

(Continued)

OTHER PUBLICATIONS

International Search Report for International Application No. PCT/US05/18494, mailed Jul. 7, 2008, 3 pgs.

(Continued)

*Primary Examiner* — Jonathan C Weber
(74) *Attorney, Agent, or Firm* — Knobbe Martens Olson & Bear, LLP

(57) ABSTRACT

An anti-chop system for a pneumatic paintball marker that is automatically cleaned. The anti-chop eye system includes a transmitter and receiver arranged so as to sense the presence of a paintball within a breech using a beam of light. A moving member of the paintball marker automatically wipes at least one surface of the transmitter and/or receiver to remove contaminants such as paint, grease, dirt and the like. By automatically cleaning the anti-chop eye system, the reliability of the system is improved.

21 Claims, 15 Drawing Sheets

U.S. PATENT DOCUMENTS

| | | | | |
|---|---|---|---|---|
| 5,727,538 | A * | 3/1998 | Ellis | 124/77 |
| 5,950,611 | A | 9/1999 | Lopez et al. | |
| 6,035,843 | A | 3/2000 | Smith et al. | |
| 6,142,137 | A | 11/2000 | MacLaughlin | |
| 6,405,722 | B2 | 6/2002 | Colby | |
| 6,516,791 | B2 | 2/2003 | Perrone | |
| 6,520,172 | B2 | 2/2003 | Perrone | |
| 6,532,949 | B1 | 3/2003 | McKendrick | |
| 6,590,386 | B1 * | 7/2003 | Williams | 42/1.01 |
| 6,644,295 | B2 | 11/2003 | Jones | |
| 6,708,685 | B2 | 3/2004 | Masse | |
| 6,807,959 | B1 | 10/2004 | Murdock et al. | |
| 6,889,682 | B2 | 5/2005 | Styles et al. | |
| 6,948,487 | B2 * | 9/2005 | Rice et al. | 124/77 |
| 6,966,313 | B1 * | 11/2005 | Yokota et al. | 124/74 |
| 7,107,981 | B1 | 9/2006 | Dunn | |
| 7,159,585 | B2 | 1/2007 | Quinn et al. | |
| 7,185,646 | B2 | 3/2007 | Jones | |
| 7,237,544 | B2 | 7/2007 | Jones | |
| 7,347,220 | B2 | 3/2008 | Carpenter et al. | |
| 7,395,819 | B2 | 7/2008 | Dobbins et al. | |
| 7,594,502 | B1 * | 9/2009 | Anderson | 124/71 |
| 7,640,923 | B1 | 1/2010 | Chen | |
| 7,765,998 | B2 * | 8/2010 | Kaakkola et al. | 124/71 |
| 7,882,830 | B1 | 2/2011 | Gabrel | |
| 2002/0088449 | A1 | 7/2002 | Perrone | |
| 2002/0096164 | A1 | 7/2002 | Perrone | |
| 2003/0005918 | A1 | 1/2003 | Jones | |
| 2003/0047175 | A1 | 3/2003 | Farrell | |
| 2003/0131834 | A1 | 7/2003 | Rice et al. | |
| 2003/0168052 | A1 | 9/2003 | Masse | |
| 2004/0084040 | A1 | 5/2004 | Jones | |
| 2004/0154600 | A1 | 8/2004 | Jong | |
| 2004/0216728 | A1 | 11/2004 | Jong | |
| 2004/0237954 | A1 | 12/2004 | Styles et al. | |
| 2005/0011507 | A1 | 1/2005 | Webb | |
| 2005/0115550 | A1 | 6/2005 | Jones | |
| 2005/0115554 | A1 | 6/2005 | Jones | |
| 2005/0133014 | A1 | 6/2005 | Jones | |
| 2005/0188973 | A1 | 9/2005 | Monks | |
| 2005/0217655 | A1 | 10/2005 | Jones | |
| 2006/0005822 | A1 | 1/2006 | Quinn et al. | |
| 2006/0011186 | A1 | 1/2006 | Jones et al. | |
| 2006/0011188 | A1 | 1/2006 | Jones | |
| 2006/0042616 | A1 | 3/2006 | Orr | |
| 2006/0107938 | A1 | 5/2006 | Rice | |
| 2006/0207587 | A1 | 9/2006 | Jones et al. | |
| 2007/0062509 | A1 * | 3/2007 | Campo et al. | 124/73 |
| 2007/0068502 | A1 | 3/2007 | Jones et al. | |
| 2007/0119988 | A1 | 5/2007 | Sheng | |
| 2007/0163661 | A1 | 7/2007 | Carpenter et al. | |
| 2007/0181117 | A1 | 8/2007 | Tippmann et al. | |
| 2007/0186916 | A1 | 8/2007 | Jones | |
| 2007/0209650 | A1 | 9/2007 | Jones | |
| 2007/0215134 | A1 | 9/2007 | DeHaan et al. | |
| 2007/0215135 | A1 * | 9/2007 | Campo | 124/77 |
| 2007/0267005 | A1 | 11/2007 | Yeh | |
| 2008/0099005 | A1 | 5/2008 | Kaakkola et al. | |
| 2008/0105245 | A1 | 5/2008 | Cole | |
| 2008/0245351 | A1 | 10/2008 | Kaakkola | |
| 2008/0264399 | A1 | 10/2008 | Dobbins et al. | |
| 2009/0064981 | A1 | 3/2009 | Dobbins et al. | |
| 2010/0051007 | A1 | 3/2010 | Telford et al. | |
| 2010/0154766 | A1 | 6/2010 | Skilling | |

FOREIGN PATENT DOCUMENTS

| | | | |
|---|---|---|---|
| GB | 2 418 007 | A | 3/2006 |
| GB | 2418007 | A * | 3/2006 |
| WO | WO 2005/033612 | A1 | 8/2004 |
| WO | WO 2005/080905 | A2 | 9/2005 |
| WO | WO 2006/073479 | A2 | 7/2006 |

OTHER PUBLICATIONS

International Search Report for International Application No. PCT/US2007/079583, mailed Jan. 22, 2008, 4 pgs.

* cited by examiner

ANTI-CHOP EYES FOR A PAINTBALL MARKER

CROSS-REFERENCE TO RELATED APPLICATIONS

This application is a continuation of copending application Ser. No. 11/540,924, filed Sep. 28, 2006, entitled "Anti-Chop Eyes for a Paintball Marker", which is hereby incorporated by reference in its entirety.

BACKGROUND OF THE INVENTION

1. Field of the Invention

The present invention relates to pneumatic guns. More specifically, this invention relates to sensing of a paintball in a paintball marker.

2. Description of the Related Art

Pneumatic paintball markers use a compressed gas, such as air or nitrogen, to propel spherical projectiles called paintballs out of the barrel of the device. Paintballs are typically comprised of a colored liquid enclosed in a fragile gelatin casing. The paintballs are designed to rupture upon impact to mark the target.

In the sport known as "Paintball," paintballs are fired at an opponent and burst upon contact, so that the colored liquid is deposited on the opponent. However, a deformation of the paintball prior to being fired can lead to jamming in the feed port of the paintball marker or only partial insertion of the paintball into the breech. A partially inserted paintball may result in the chopping of the paintball and fouling of the breech and barrel.

A sensor is recessed within the breech and senses the presence of a paintball. Known sensors are mounted by drilling a hole through the breech and locating the sensor within the hole so as to be recessed from the breech. The sensor may be a break beam type having a sending part on one side of the breech and a sensor, like a phototransistor, on the other side of the breech.

The paintball that falls into the breech of the gun breaks the light beam. A user may then fire the paintball marker. Alternatively, a transceiver is placed on one side of the breech and transmits a beam of light into the breech. Instead of the light being sensed on the opposite side of the breech, the transceiver senses the reflection of the light beam off of a paintball. When the beam of light reflects off of the paintball and back towards the transceiver, the paintball gun may be fired.

However, when contaminants such as dirt, water, lubricant, or paint from a broken paintball gets inside the breech of the paintball gun the sensor gets "dirty" and is unable to correctly indicate whether a paintball is properly positioned within the breech. If the anti-chop eyes become dirty, the marker may default to a reduced rate of fire to prevent chopping. Once contaminated, the user manually cleans the sensors to enable the eye function.

SUMMARY OF THE INVENTION

In view of the foregoing, a need exists for an anti-chop eye system having more reliable operation.

An aspect of the invention is directed to a pneumatic marker that includes a body member that has a longitudinal bore and a sensor system. The sensor system has at least a first surface and transmits a signal through the first surface so as to sense a paintball within the bore. The marker further includes a moving member disposed in the bore and has a protrusion.

The protrusion contacts at least a portion of the first surface when the bolt moves from a first position to a second position.

Another aspect of the invention is a pneumatic marker that includes a body member that has a longitudinal bore and a transmitter. The marker further includes a first lens disposed between the transmitter and the longitudinal bore and a receiver. The marker further includes a second lens disposed between the receiver and the longitudinal bore and a bolt disposed in the bore. The bolt contacts at least a portion of at least one of the first and second lenses when the bolt moves from a first position to a second position.

Another aspect is an antic-chop eye system for a pneumatic marker. The system includes a breech member that has a longitudinal bore and a transmitter configured to transmit light through an inner surface of the breech member. The system further includes a receiver configured to receive at least a portion of the light transmitted through the inner surface of the breech member and a bolt disposed in the bore and contacting at least a portion of the inner surface when the bolt moves from a first position to a second position.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled "Detailed Description of the Preferred Embodiments," one will understand how the features of the system and methods provide several advantages over conventional paintball markers.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

DETAILED DESCRIPTION OF THE PREFERRED EMBODIMENTS

The following detailed description is now directed to certain specific embodiments of the invention. In this description, reference is made to the drawings wherein like parts are designated with like numerals throughout the description and the drawings.

The anti-chop eye system inhibits a pneumatic paintball marker from breaking paintballs within the marker which is commonly called, chopping paint. The anti-chop eye system does not allow the marker to fire until a paintball is fully seated in front of the bolt or at least positioned so as to minimize the risk of chopping paint. Certain embodiments of the anti-chop eye system have a transmitting device that sends a beam in the barrel cavity to identify the paintball location. A sensing device may be located on the same or opposite side of the barrel cavity from the transmitting device. In certain embodiments the beam crosses the barrel cavity and is sensed by the sensing device when the paintball is unloaded. In certain embodiments the beam is reflected off the paintball and towards the sensing device when the paintball is loaded.

The beam passes through a transmitting surface before entering the breech or barrel cavity. After crossing the barrel cavity, the beam passes through a receiving or sensing surface. Preferably, the transmitting surface and the receiving surface are disposed relative to the surface of the barrel cavity so as to be automatically wiped or cleaned during operation of the pneumatic paintball marker.

For example, the transmitting and sensing surfaces may be disposed relative to a reciprocating piston, sleeve, or the like so that during use of the paintball marker the reciprocating member removes contaminants or the like from the transmitting and/or sensing surfaces. In certain embodiments, the reciprocating member directly contacts the surfaces of a first lens associated with a transmitter and a second lens associated with a receiver. Preferably when the reciprocating member moves past the lenses, contaminants on the surfaces of the lenses are removed. In certain embodiments, the reciprocating member directly contacts the surface of a unitary transmitter and lens and the surface of a unitary receiver and lens. Accordingly, the transmitting surface may be a surface of a separate lens or of the transmitter itself. Similarly, the receiving surface may be a surface of a separate lens or of the receiver itself.

Figure 1:
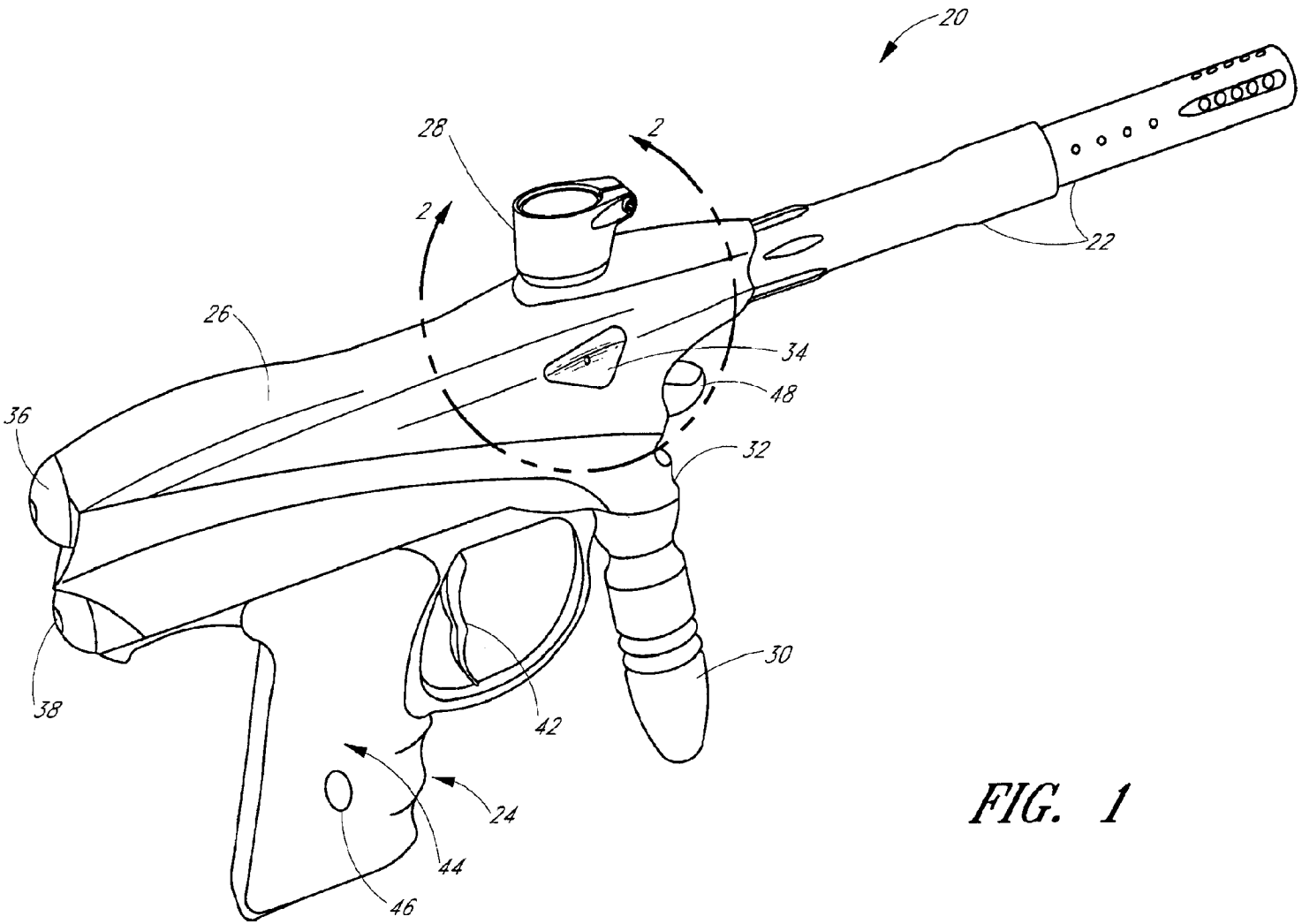
FIG. 1 depicts a perspective view of a pneumatic paintball marker according to a preferred embodiment of the present invention.

FIG. 1 depicts a perspective view of a pneumatic paintball marker 20 according to a preferred embodiment of the present invention. The view generally shows the right side of the pneumatic paintball marker 20. A barrel 22 is located at the front of the pneumatic paintball marker 20. A handgrip frame 24 is located near the back of the pneumatic paintball marker 20. The barrel 22 may be a two-piece type barrel and thread into the front of the body 26 of the pneumatic paintball marker 20. A paintball loading chamber is disposed on the top of the body 26 and may comprise an adjustable feed neck 28 to fit paintball loaders of different dimensions. An in-line pressure regulator 30 is threaded into an in-line pressure regulator adapter 32.

The pneumatic paintball marker 20 further includes an anti-chop eye system within the body 26. Removable cover plates 34 on either side of the body 26 allow a user to access the anti-chop eye system.

At the back of the body 26 is an exposed rear portion of a bolt assembly 36 and a low-pressure regulator threaded cap 38. At least a portion of the bolt assembly 36 reciprocates within the body 26 generally along the longitudinal axis of the barrel 22 and between forward and back positions.

The handgrip frame 24 preferably houses the electronics of the pneumatic paintball marker 20. The electronics include electronics and a power source for the anti-chop eye system. The electronics for the anti-chop eye system may include, for example, an arrangement of resistors, capacitors, and transistors which supply a signal to a processor running software and which is located in the handgrip frame 24. The processor receives at least data coming from the anti-chop eye system to determine whether the paintball is correctly positioned within the breech 57. The power source may be, for example, a battery or a capacitor. The electronics will inhibit the pneumatic paintball marker 20 from breaking the paintballs within the marker by not allowing the pneumatic paintball marker 20 to fire until a paintball is fully seated in a breech 57 in front of the bolt assembly 36.

The handgrip frame 24 may be enclosed on the sides and front by a grip cover 44. The grip cover 44 may comprise urethane, plastic, or the like. The grip cover 44 may comprise a combination of materials, for example, a poly propylene base and a thermo plastic elastomer (TPE). The rear surface of the handgrip frame 24 may incorporate the on and off switches for the electronics. The right side of the grip cover 44 may include an anti-chop indicator lamp 46. The handgrip frame 24 further comprises a trigger mechanism 42.

The body 26 is generally gun-shaped, and in one embodiment is manufactured as a single metal piece with a computer numerically controlled ("CNC") machine. To activate or deactivate the pneumatic paintball marker 20 the operator will press the on or off button on the rear surface of the handgrip frame 24. Power is supplied to the pneumatic paintball marker 20 by, for example, a battery housed along with a printed circuit board within the handgrip frame 24.

The pneumatic paintball marker 20 consists of a device where compressed air or nitrogen gas is supplied to the pneumatic paintball marker 20 by the means of an in-line pressure regulator 30. A wide variety of compressed gasses will work equally well within the pneumatic paintball marker 20 as well as compressed air. The in-line pressure regulator 30 threads into the in-line pressure regulator adapter 32 that is attached at the front of the body 26 of the pneumatic paintball marker 20 below an on/off compressed air control valve 48. A user may adjust the output pressure from the in-line pressure regulator 30. High-pressure compressed air is supplied from a tank or other compressed gas storage container to the in-line pressure regulator 30 at the base.

The on/off compressed air control valve 48 is preferably located under the barrel 22 at the front of the pneumatic paintball marker 20 and adjacent to the in-line pressure regulator adapter 32. To turn the compressed air on, the on/off compressed air control valve 48 will be rotated in a counterclockwise direction, and to turn the gas off, the on/off compressed air control valve 48 will be rotated in a clockwise direction.

The rear cap of the bolt assembly 36 is accessible from the outside of paintball marker 20 through an opening in the body 26. At least a portion of the bolt assembly 36 is fastened to the opening in the body 26 by, for example, a threaded connection. Consequently, the bolt assembly 36 can be removed as a single piece by unscrewing the rear cap from the opening.

The bolt assembly 36 includes at least one component that moves during operation of the paintball marker 20. In the embodiment illustrated in FIG. 1, a bolt reciprocates between a forward or firing position and a rearward or loading position. In other embodiments of the pneumatic paintball marker 20, the moving component is a sleeve which reciprocates during operation of the pneumatic paintball marker 20 around a stationary piston. Alternatively, the pneumatic paintball marker 20 may include a stacked hammer and bolt as known in the art. The invention is not limited to a particular embodiment of a paintball marker 20 but includes embodiments that have at least one component that moves generally along the longitudinal axis so as to pass across at least a portion of at least one of the transmitting or receiving surfaces of the anti-chop eye system.

In the illustrated embodiment, air is supplied to the bolt assembly 36 at two locations along the longitudinal axis of the bolt assembly 36. A high-pressure supply of air is routed to the back of the bolt assembly 36. The high-pressure air source is responsible for propelling the paintball out of the barrel 22. Low-pressure air is supplied from the low-pressure regulator to a forward portion of the bolt assembly 36 or cylinder. The low-pressure air moves the moving member or bolt between the firing and loading positions. A paintball marker that routes gas in this manner is described in PCT publication number WO 2006/073479 A2, titled Pneumatic Paintball Marker and published on Jul. 13, 2006, which is incorporated by reference in its entirety.

Of course the moving member need not be moved by the low pressure air and may instead be moved by the high pressure air. Further, the moving member may be moved in a first direction along the longitudinal axis by applying pressurized air and moved in an opposite direction by reducing or increasing the applied pressurized air. When the bolt is in the firing position, the pressurized air passes through the bolt assembly 36 and contacts and ejects the paintball from the barrel 22.

Figure 2:
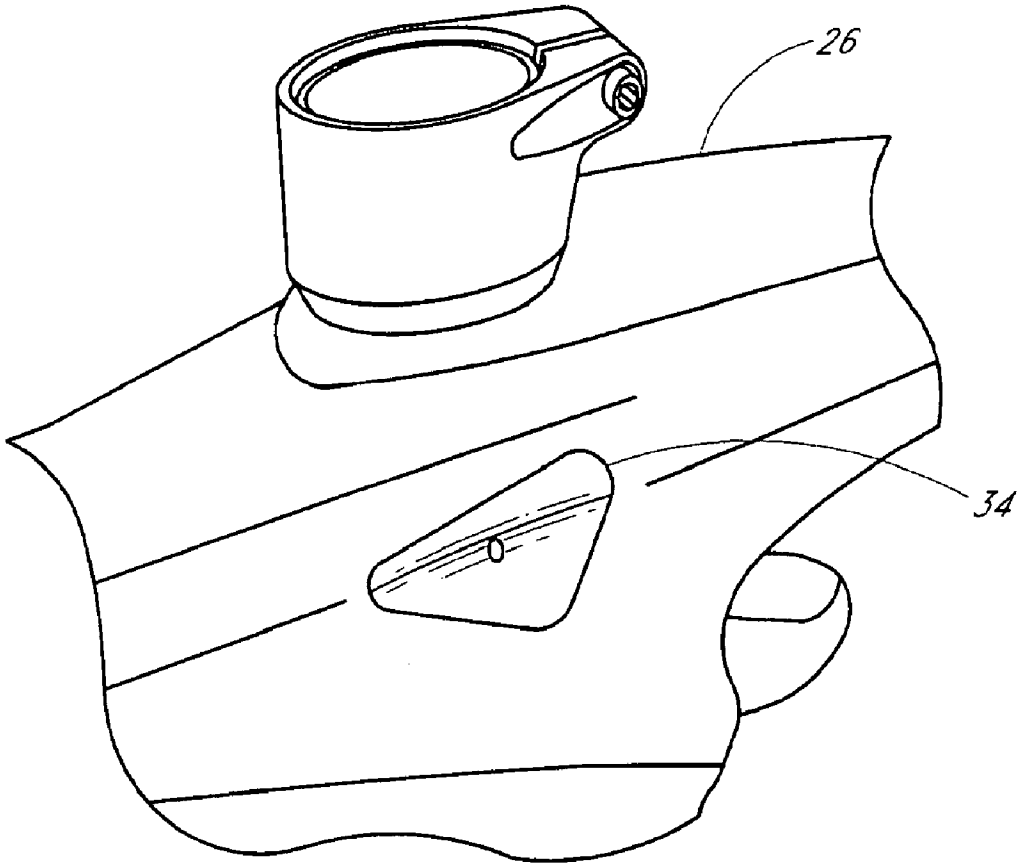
FIG. 2 depicts a partial perspective view of the pneumatic paintball marker from FIG. 1 with a right cover plate installed over an anti-chop eye system.

FIG. 2 depicts a partial perspective view of the pneumatic paintball marker 20 from FIG. 1 with a right cover plate 34 disposed over a right side of the anti-chop eye system. The anti-chop eye system is installed within the body 26 by removing the cover plates 34. A user removes the left and right cover plates 34 to access components of the anti-chop eye system if necessary. Instead of being located on both sides of the body 26, the anti-chop eye system may be located on a single side of the body 26. In such an embodiment, a beam of light transmitted from a first side can be reflected back to the same side to indicate that a paintball is properly positioned within the breech prior to firing.

Figure 3:
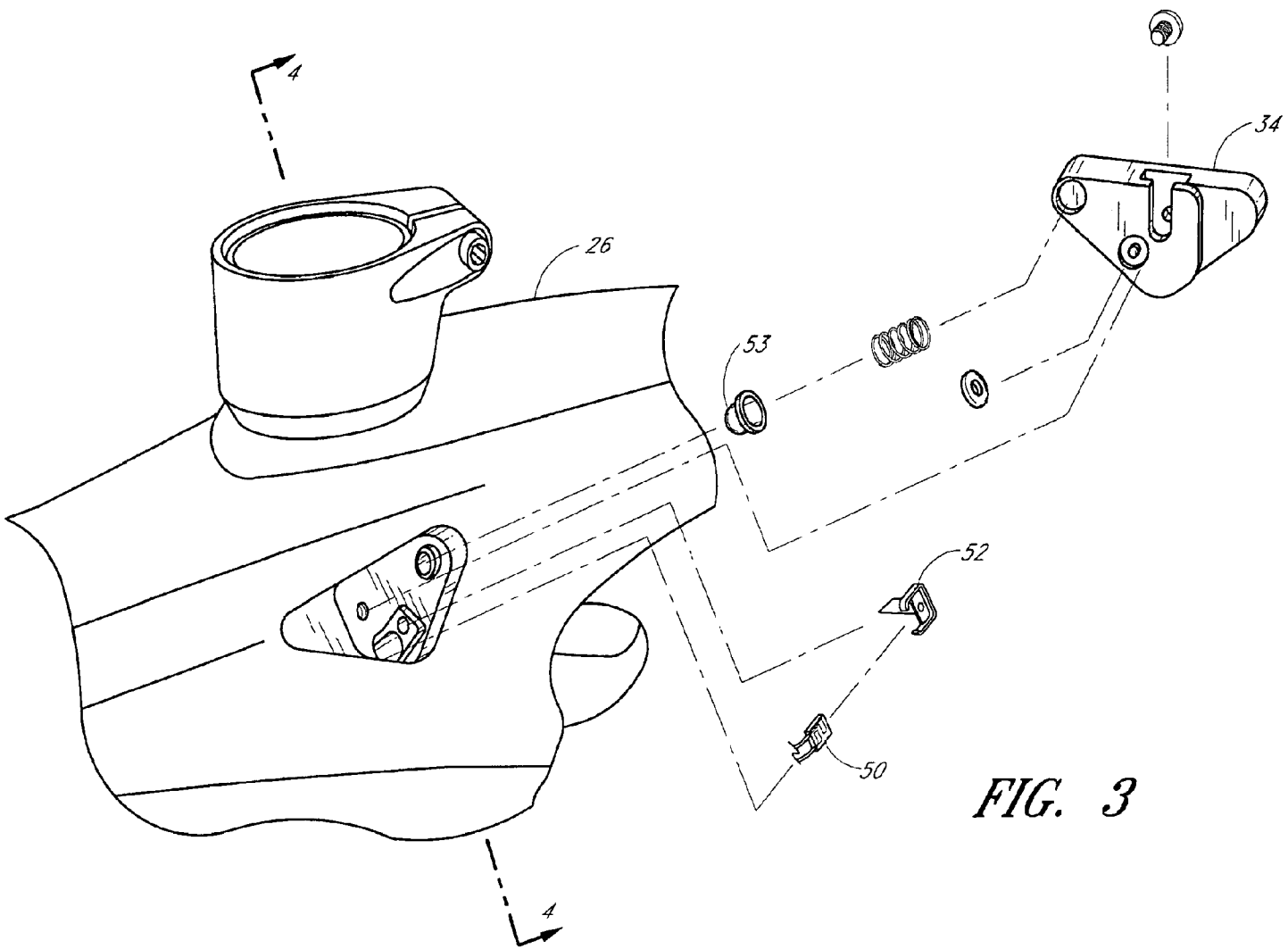
FIG. 3 is an exploded view of exemplary components of the anti-chop eye system from FIG. 2 that are located under the right cover plate.
Figure 4:
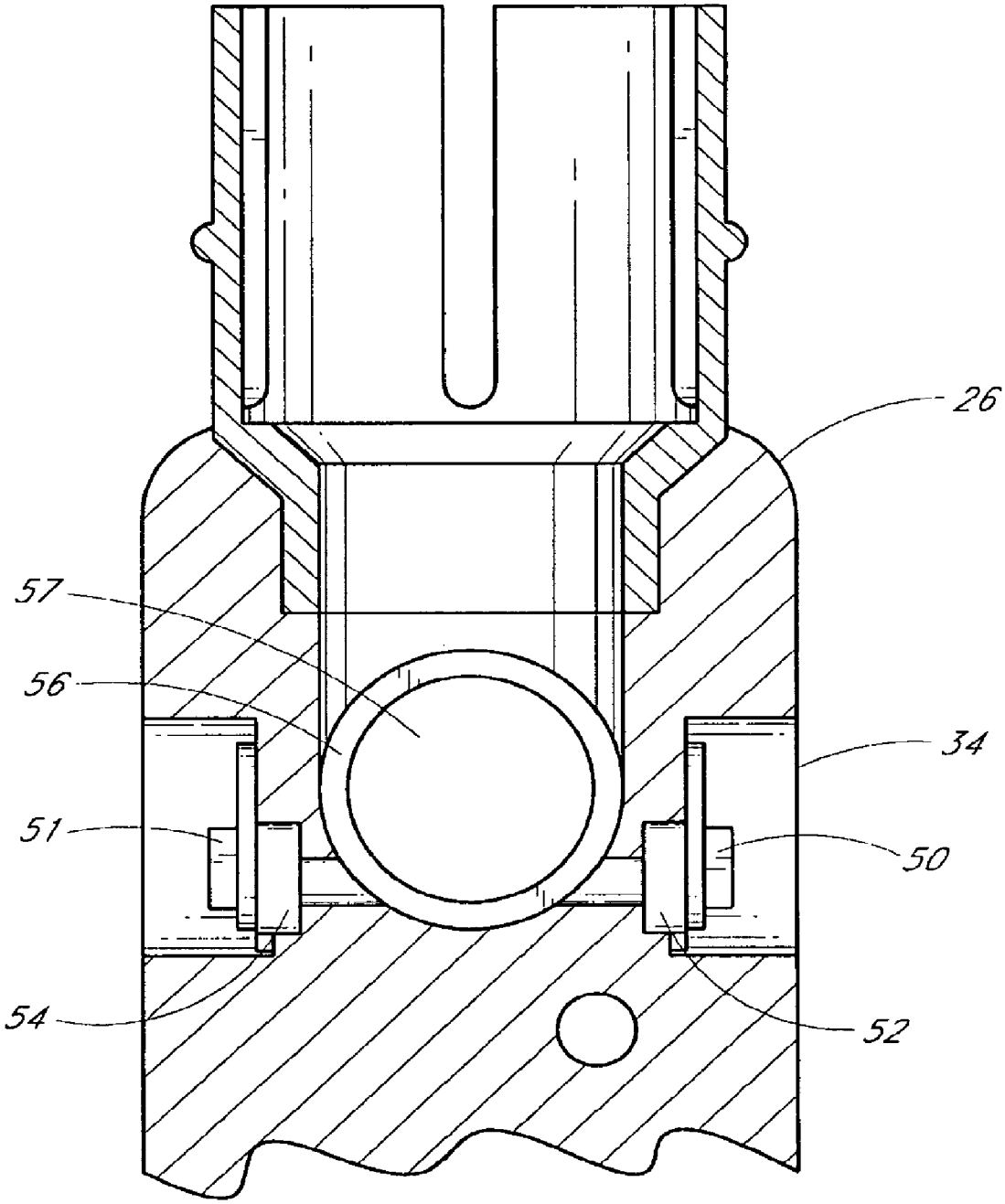
FIG. 4 is a cross-section view taken along lines 4-4 in FIG. 3 and shows first and second lenses of the anti-chop eye system disposed on opposite sides of the breech.

FIG. 3 is an exploded view of exemplary components of the anti-chop eye system from FIG. 2 that are located under the right cover plate 34. FIG. 4 is a cross-section view taken along lines 4-4 in FIG. 3 and shows a first lens 52 and a second lens 54 of the anti-chop eye system disposed on opposite sides of the body 26. As most clearly shown in FIGS. 3 and 4, the anti-chop eye system includes a first lens 52 and a transmitter 50 on a first side of the body 26. The system further includes a second lens 54 and a receiver 51 disposed generally on the opposite side of the body 26. Wires from the receiver 51 and the transmitter 50 are routed through the housing 26 to the electronics in the handgrip frame 24. The processor running software processes the data signal received from the receiver 51 to determine whether the paintball is properly positioned and allows the pneumatic paintball marker 20 to fire the paintball.

The first lens 52 is positioned relative to the second lens 54 so that the light beam exiting the first lens 52 passes through the second lens 54 and is sensed by the receiver 51. As most clearly shown in FIG. 4, the first lens 52 and the second lens 54 are located below the longitudinal axis of the barrel 22 or on the side of the longitudinal axis that is closest to the handgrip frame 24. As is illustrated in FIG. 4, the second lens 54 need not be on the diametrically opposite side of the breech relative to the location of the first lens 52. The second lens 54 need only be positioned around the breech 57 so that a light beam passing between the first lens 52 and the second lens 54 crosses a portion of the breech 57.

Of course the first lens 52 and the second lens 54 could switch positions so that the first lens 52 is on the left side of the body 26 and the second lens 54 is on the right side of the body 26. The transmitter 50 could be associated with the second lens 54 with the receiver 51 being associated with the first lens 52.

In the illustrated embodiment, the transmitter 50 is on one side of the breech 57 and the receiver 51 is on the opposite side of the breech 57. The transmitter 50 transmits a light beam across the barrel cavity and towards the second lens 54. The light beam may include one or more wavelengths of light.

In order for the marker 20 to fire with the anti-chop eyes turned on, the signal between the first and second lenses 52, 54 must be broken or at least diminished. After every shot and before the next paintball drops in the breech 57, the receiver 51 recognizes the transmitter 50. If the lenses 52, 54 are dirty and the receiver 51 cannot see the transmitter 50 between shots, the anti-chop indicator lamp 46 in the handgrip frame 24 that can be seen through the grip cover 44 will start blinking green. When the indicator lamp 46 is blinking, the anti-chop eyes are dirty.

The pneumatic marker 20 further includes ball detents 53 on either side of the body 26. The ball detents 53 may be made of rubber or other like material. The ball detents 53 retain the paintballs in position between the transmitter 50 and the receiver 51 prior to the firing of the pneumatic paintball marker 20. The ball detents 53 inhibit the paintball positioned within the breech 57 from rolling down the breech 57 and out of the barrel 22. The ball detents 53 may also inhibit "double feeding" of paintballs.

The first lens 52 is preferably separate from the second lens 54. In other embodiments, the first and second lenses 52, 54 are part of a single assembly that is installed within the body 26. For example, the first and second lenses 52, 54 could be attached to a circular or horseshoe shaped insert. The insert is inserted into a slit or gap in the body 26 so that a beam passing between the first lens 52 and the second lens 54 passes through at least a portion of the breech 57 so as to sense the presence of a paintball within the breech 57.

In the illustrated embodiment, each lens 52, 54 is a separate component from the transmitter 50 and the receiver 51. With this embodiment, an off the shelf transmitter 50 and receiver 51 may be employed in combination with the lens 52, 54. The receiver 51 and transmitter 50 may be combined into a single unit or transceiver as known to one having ordinary skill in the art.

Alternatively, the transmitter 50 includes an integral casing. For example, the first lens 52 may be integral to the transmitter 50. In such an embodiment, the outer surface of the casing or lens of the transmitter 50 preferably follows the radius of the breech 57 and/or the portion of a moving member or bolt 56 which wipes the surface of the casing. The receiver 51 may include an integral casing that also follows the radius of the breech and/or the portion of the moving member or bolt 56 which wipes the surface of the casing.

The first and second lenses 52, 54 preferably pass through a predetermined wavelength of light. In certain embodiments, the anti-chop eye system includes one or more filters. For example, the receiver 51 and/or second lens 54 may include a filter medium which allows the predetermined wavelength of light to pass therethrough. The filter medium may filter other wavelengths of light which may interfere with the receiver 51 sensing the predetermined wavelength of light. Of course the filter medium may be a separate component of the anti-chop eye system and disposed in the path of the beam if light so that the beam of light passes through the filter. A polarizer may also be employed in the anti-chop eye system. The polarizer converts an unpolarized or mixed-polarization beam of electromagnetic waves (e.g., light) into a beam with a single polarization state.

Preferably, the intensity of the chosen wavelength does not appreciable drop as the light passes through the first and second lenses 52, 54 or at least maintains an adequate intensity so that the intensity of the light received by the receiver 51 may be sensed by the receiver 51. Exemplary materials for the lenses 52, 54 include plastics, glass, ceramics, or the like that allow the predetermined wavelength of light for the anti-chop eye system to pass there through. For example, the lenses may comprise an acrylic resin, a polycarbonate material, another thermoplastic material, or the like. Preferably, the lenses 52, 54 comprise a clear plastic or glass material.

The transmitter or sending part may be an Infra red light emitting diode (LED). Fore example, the transmitter 50 may be a light emitting diode ("LED") and the receiver 51 may be a photo-transistor. An exemplary wavelength for the light generated by the transmitter 50 is 940 nm. In other embodiments, the wavelength is 880 nm. Of course the invention is not limited to a specific wavelength and accordingly may employ a transmitter 50 that transmits any wavelength of electromagnetic radiation including, for example, wavelengths on the visible spectrum as well as wavelengths in the IR spectrum. The signal received by the phototransistor may be processed by software resident in the paintball marker 20.

For embodiments of the anti-chop eye system that employ an LED transmitter 50 and a phototransistor receiver 51, a negative port of the LED transmitter 50 may be connected to a resistor. A positive port of the LED transmitter 50 may be connected to the processor running software. The processor is preferably located in the handgrip frame 24. The processor may operate the LED transmitter 50 continuously or in a pulsed fashion. By pulsing the LED transmitter 50 rather than continuously operating the LED transmitter 50, battery power may be saved.

A negative port of the phototransistor receiver 51 may be connected to the processor with a resistor, for example, a 4.7 kohm pull down resistor. A positive port of the phototransistor receiver 51 may be connected to a power supply, such as a microprocessor, which energizes the phototransistor receiver 51 when the anti-chop eye system is operating. In operation, when the phototransistor receiver 51 is receiving the light transmitted by the LED transmitter 50, the processor connected to the negative port of the phototransistor receiver 51 registers a high signal, for example, +5 volts. When the phototransistor receiver 51 is not receiving the light transmitted by the LED transmitter 50, the pull down resistor connected to the negative port of the phototransistor receiver 51 drops the signal to, for example, substantially 0 volts.

The reliability of the anti-chop eye system is improved if the receiver 51 is able to distinguish between the light being emitter by the transmitter 50 and any ambient light. Ambient light includes direct sunlight which contains the full spectrum of light and may be intense. Preferably, the receiver 51 does not receive light from other sources that contains the wavelength used by the transmitter 50. The receiver 51 may distinguish between light coming from the transmitter 50 and another source by being tuned to the transmission wavelength and/or by modulating the light transmitted by the transmitter 50. For example, the signal emitted by the transmitter 50 may be modulated by turning the signal on and off at a predetermined interval. The receiver 51 is configured to distinguish the modulated signal at a given wavelength from other potentially interfering signals having the same wavelength, for instance, from sunlight or the color of the paintball. This enables the device to be sure that the signal the receiver 51 is receiving is actually the one being sent by the transmitter 50.

Figure 5A:
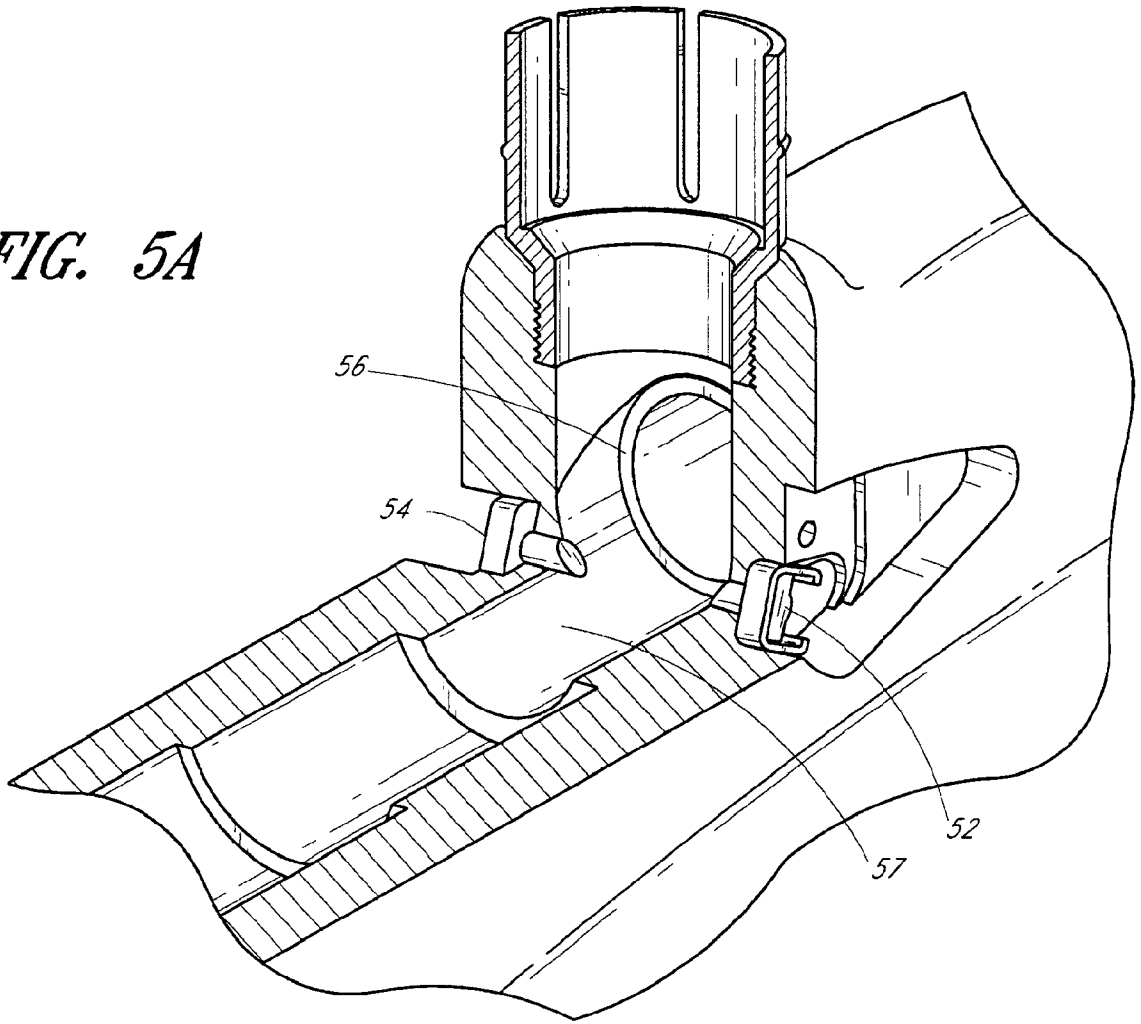
FIG. 5A is a partial cross-section view through the pneumatic paintball marker of FIG. 2 showing the pneumatic bolt in a loading position.
Figure 5B:
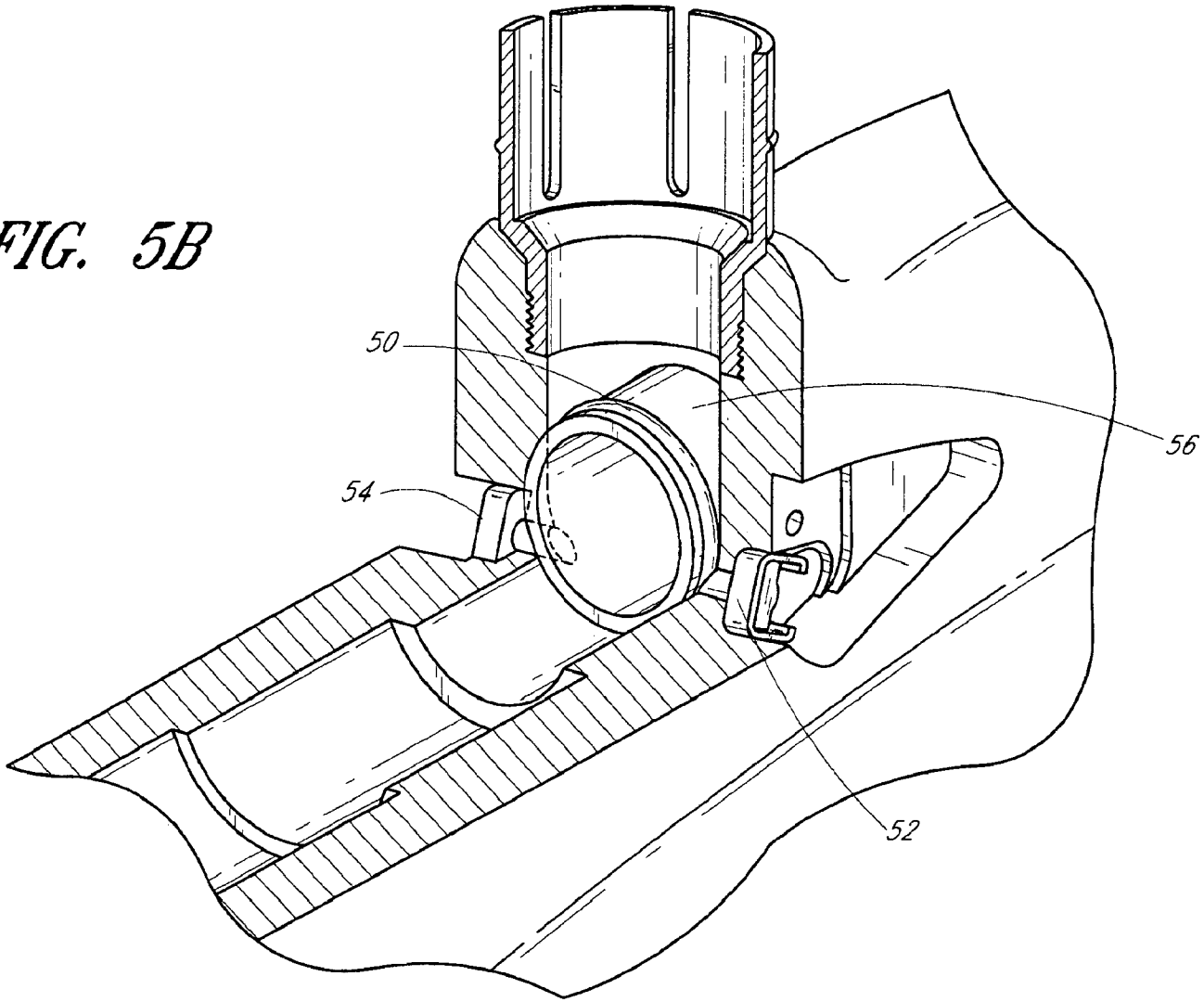
FIG. 5B is the partial cross-section view shown in FIG. 5A with the pneumatic bolt in a position so as to contact the anti-chop eye system.

FIG. 5A is a partial cross-section view through the pneumatic paintball marker 20 of FIG. 2 showing the pneumatic bolt 56 in a loading position. FIG. 5B is the partial cross-section view shown in FIG. 5A with the pneumatic bolt 56 in a forward longitudinal position so as to contact the outer surfaces 66 of the first and second lenses 52, 54 of the anti-chop eye system. A portion of the moving member or bolt 56 preferably wipes the outer surfaces 66 of the first and second lenses 52, 54.

The moving member or bolt 56 may have a raised surface that extends entirely around the bolt 56 or only locally in the region of one or both of the first and second lenses 52, 54. In the illustrated embodiment, the bolt 56 has a radially extending surface that extends around the entire circumference of the bolt 56. The radially extending surface may be integral to the bolt 56 or may be a separate member, such as an o-ring 58 or the like. As most clearly shown in FIG. 5B, an o-ring 58 is disposed within a circumferential groove in the bolt 56. The o-ring 58 may have a diameter greater than the depth of the groove. In this way, the outer surface of the o-ring 58 extends beyond the outer circumference of the bolt 56 so as to wipe the outer surfaces 66 of the first and second lenses 52, 54 when the moving member or bolt 56 moves between the forward and rearward positions. The depth of the groove need not be less than the diameter of the o-ring 58. For example, the o-ring 58 need not protrude beyond the surface of the moving member or bolt 56 in the regions that are not aligned with the first and second lenses 52, 54.

Alternatively, the outer surface of the bolt 56 may include a protrusion disposed at a specific radial location around the outer circumference of the bolt 56 that is aligned with one or both outer surfaces 66 so as to wipe across one or both outer surfaces 66 of the first and second lenses 52, 54 when the moving member 56 moves between forward and rearward positions.

Figure 5C:
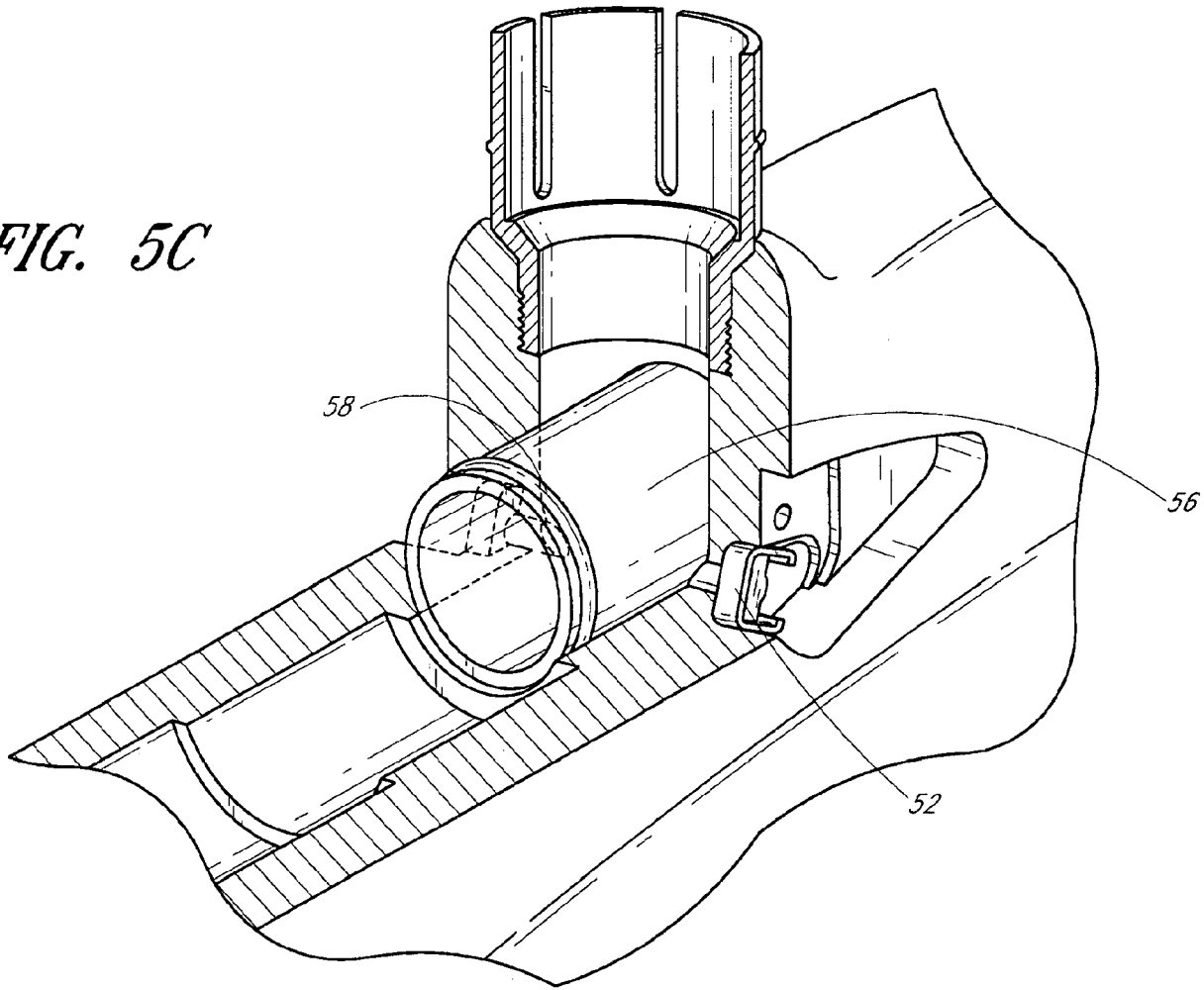
FIG. 5C is the partial cross-section view shown in FIG. 5A with the pneumatic bolt moved to a firing position.

FIG. 5C is the partial cross-section view shown in FIG. 5B with the pneumatic bolt 56 moved to a firing position. The bolt 56 wipes the outer surfaces 66 and removes contaminants such as, for example, paint and dirt from the outer surfaces 66. The wiping of the surfaces preferably occurs each time the bolt 56 moves between the forward and rearward positions. Alternatively, the surfaces are periodically wiped by the moving member or bolt 56. For example, the pneumatic paintball marker 20 may include a mechanical system that periodically moves the outer surfaces 66 towards the breech 57 so that the outer surfaces 66 are periodically wiped by the moving member or bolt 56. This mechanical actuation may be user initiated by a button or lever.

The outer surfaces 66 of the first and second lenses 52, 54 facing the breech 57 may be substantially flat or curved. Preferably for embodiments having two lenses 52, 54, portions of the outer surfaces 66 of the first and second lenses 52, 54 through which the beam passes have shapes or radii that substantially match the radius of the breech 57 and/or the portion of the moving member or bolt 56. For example, the surface of the lens and the moving member or bolt 56 may have corresponding curved surfaces. In this way, the corresponding surfaces of the moving member or bolt 56 will contact the corresponding surfaces of the first and second lenses 52, 54 and remove enough dirt or other contaminants from at least the surfaces of the first and second lenses 52, 54 to maintain operation of the anti-chop eye system. With the curvature of the outer surfaces of the lenses 52, 54 substantially matching the inside of the breech 57 or outer surface of the bolt 56, a more complete wiping or cleaning of the outer surfaces may be achieved.

The first and second lenses 52, 54 may have substantially flat outer surfaces 66. The first and second lenses 52, 54 may be disposed so that a center region of the surfaces are tangent to the outer circumference of the moving member or bolt 56 that wipes the first and second lenses 52, 54. The outer surfaces 66 may be positioned relative to the outer surface of the bolt 56 so that the bolt 56 only wipes the portions of the outer surfaces through which the beam passes. The other portions of the outer surfaces may be inset from the surface of the bolt 56. The inset portions may accumulate dirt or other contaminants. However, the bolt 56 removes enough of the dirt or contaminants from the portions of the lenses 52, 54 through which the beams passes to maintain operation of the anti-chop eye system even if the inset portions are dirty.

The portion of the outer surface of the moving member or bolt 56 that wipes the first and second lenses 52, 54 may have a substantially flat surface that corresponds to a substantially flat surface of the first and second lenses 52, 54. With this embodiment, a larger portion of the flat surfaces of the first and second lenses 52, 54 may be wiped by the moving member or bolt 56 as compared to an embodiment that has a flat outer surface 66 and a curved bolt.

One or both of the first and second lenses 52, 54 may be disposed so that at least portions of the outer surfaces 66 are tangent to the surface of the breech 57 along the longitudinal axis of the breech 57 or may slightly protrude into the breech 57. In this way, at least a portion of the moving member or bolt 56 wipes across the outer surfaces 66 when the bolt 56 moves between rearward and forward positions. With the first and second lenses 52, 54 protruding slightly into the breech 57, even if the diameter of the bolt 56 is slightly smaller than the diameter of the breech 57, the bolt 56 will still wipe the surfaces of the first and second lenses 52, 54 when the bolt 56 moves between the rearward and forward positions.

Alternatively, the first and second lenses 52, 54 may be slightly recessed from the surface of the breech 57 with the bolt 56 having a raised surface that protrudes slightly outside of the breech 57 so as to wipe one or both lenses 52, 54. Importantly, at least a portion of the moving member or bolt 56 passes close enough to at least a portion of one or both surfaces of the first and second lenses 52, 54 so as to remove contaminants from the surfaces.

Of course the invention is not limited to embodiments of lenses and bolts that have surfaces with particular contours or to embodiments having lenses 52, 54 with surface contours that match surface contours of the corresponding portions of the moving member or bolt 56 as long as the moving member or bolt 56 removes enough dirt or other contaminants from at least a portion of the outer surface of at least one transmitting or receiving surface to maintain operation of the anti-chop eye system.

Figure 6:
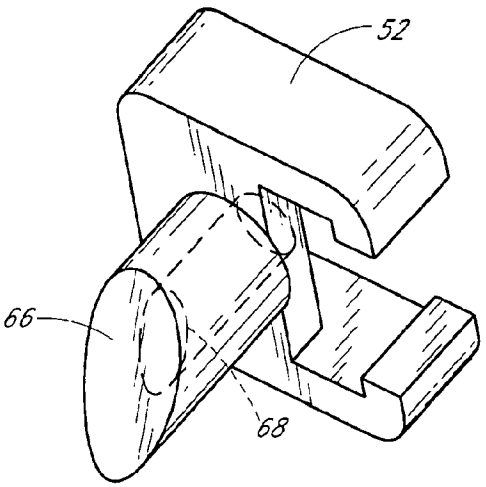
FIG. 6 is a perspective view of the first and second lenses of the anti-chop eye system.
Figure 6:
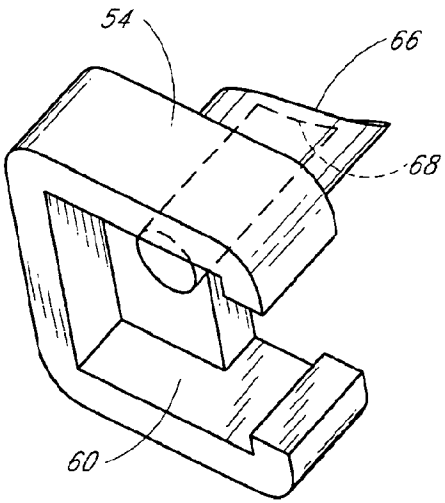

FIG. 6 is a perspective view of the first lens 52 and the second lens 54 of the anti-chop eye system. Preferably the respective outer surfaces 66 and inner surfaces 68 of each lens 52, 54 have complementary surfaces contours so that the path of the light beam entering a lens is substantially parallel to the path of the light exiting that same lens. For example, the curvature of the outer surface 66 of the first lens 52 may be selected to correspond to the curvature of the inner surface 68 of the lens 52. Light enters the first lens 52 from the inner surface 68 of the first lens 52 or first boundary and exits through the outer surface 66 of the first lens 52 or second boundary before entering the breech 57. Light then enters the second lens 54 through the outer surface 66 of the second lens 54 or third boundary and exits through the inner surface 68 of the second lens 54 or fourth boundary. With complementary shapes, the refraction of the light as the light passes through the first boundary of the first lens 52 is cancelled by the refraction caused by the light passing through the second boundary of the first lens 52. Similarly, with complementary shapes, the refraction of the light as the light passes through the third boundary of the second lens 54 is cancelled by the refraction caused by the light passing through the fourth boundary of the second lens 54. In this way, the incident angle of the light entering the lenses 52, 54 is substantially the same as the exit angle of the light from the respective lens 52, 54. As explained above, it is also preferred that the outer surfaces 66 substantially match the contour of the wall of the breech 57 so as to facilitate the cleaning of the outer surfaces 66.

Of course the inner surface 68 and the outer surface 66 are not required to have the same shape for a given lens in that the entering and exiting light paths through the lens need not be parallel. For example, the shapes of the inner surfaces 68 and the outer surfaces 66 may not be parallel and cause the exiting light beam to be at an angle relative to the entering light beam. In such an embodiment, the receiver 51 may be disposed on the other side of the breech 57 so that the light beam exiting the first lens 52 reaches the receiver 51 and corrects for the bending of the light beam. Accordingly, the first lens 52 need not be directly aligned with the second lens 54. As explained above, in certain embodiments the receiver 51 is disposed on the same side of the breech 57 and receives a signal reflected off the paintball.

Figure 7:
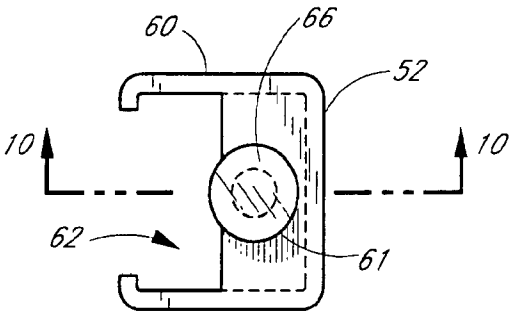
FIG. 7 is a top view of the first lens shown in FIG. 6.

FIG. 7 is a top view of the first lens 52 shown in FIG. 6. As most clearly shown in FIG. 6, the shape of the second lens 54 may be a mirror copy of the shape of the first lens 52 across the longitudinal axis of the pneumatic paintball marker 20. Accordingly, the description of the first lens 52 applies with equal force to the second lens 54 and will not be repeated. The first lens 52 includes a base 60 and a post 61 disposed on the base 60. The base 60 includes a recess 62 configured to receive the transmitter 50 of the anti-chop system. As illustrated in FIG. 6, the second lens 54 includes a recess 62 configured to receive the receiver 51 of the anti-chop system. A light beam emitted by the transmitter 50 preferably is substantially parallel with axis 64. Of course, the first lens 52 and the transmitter 50 and/or the second lens 54 and the receiver 51 may each be a unitary component.

Figure 8:
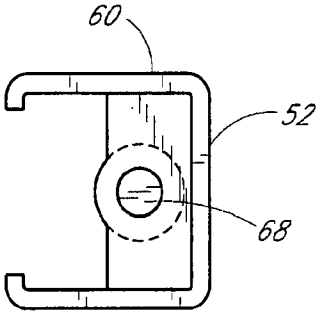
FIG. 8 is a bottom view of the first lens from FIG. 6.
Figure 9:
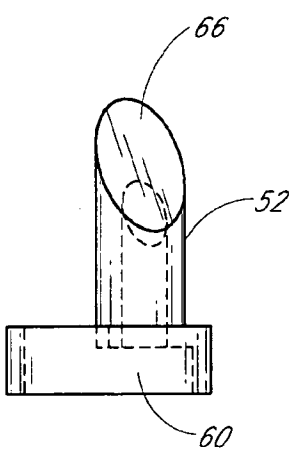
FIG. 9 is side view of the first lens from FIG. 6.

FIG. 8 is a bottom view of the first lens 52 from FIG. 6 and shows an inner surface 68. FIG. 9 is side view of the first lens 52 from FIG. 6. The post 61 includes an outer surface 66 or transmission surface through which light passes when entering or exiting the breech 57.

Figure 11:
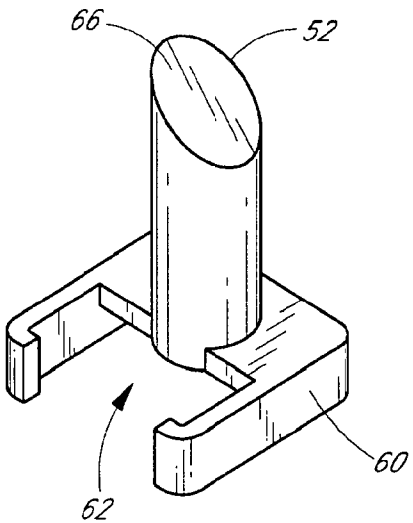
FIG. 11 is a perspective view of the first lens of the anti-chop eye system from FIG. 6.
Figure 10:
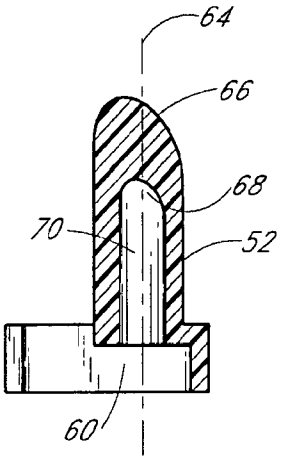
FIG. 10 is a cross-section view taken along lines 10-10 in FIG. 7.

FIG. 10 is a cross-section view taken along lines 10-10 in FIG. 7 and shows a channel 70 extending from the base 60 toward the inner surface 68. As most clearly shown in FIG. 10, the inner surface 68 and the outer surface 66 have substantially the same radius of curvature. The post 61 further includes an internal channel 70. The recess 62 may extend from an open side of the base 60 and across the opening to the channel 70. The bottom of the channel 70 defines the inner surface 68 of the first lens 52 through which light passes when entering or exiting the first lens 52. For embodiments of the anti-chop system that have first and second lenses 52, 54 on opposite sides of the breech 57, the inner surface 68 and the outer surface 66 of each lens preferably have substantially the same surface contour so as to limit bending of the light beam due to refraction caused by the light beam passing through the boundaries between the inner and outer surfaces of the first and second lenses 52, 54 and the air. FIG. 11 is a perspective view of the first lens 52 of the anti-chop eye system from FIG. 6.

Other Embodiments

Figure 12:
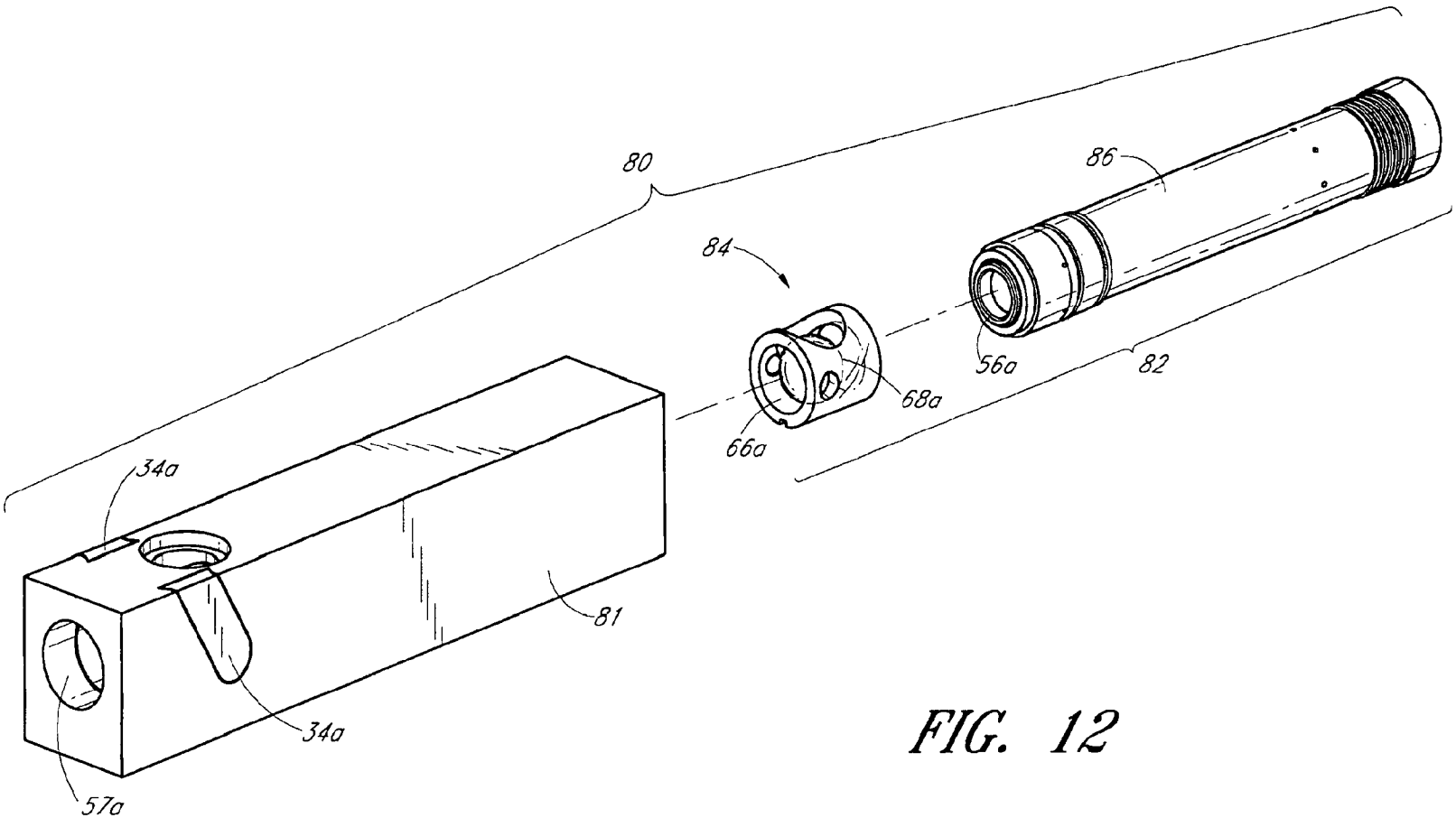
FIG. 12 is an exploded perspective view of a barrel assembly that has an anti-chop eye system according to another embodiment of the present invention.

FIG. 12 is an exploded perspective view of a barrel assembly 80 that has an anti-chop eye system according to another embodiment of the present invention. The view generally shows the right side of the barrel assembly 80. The barrel assembly 80 is an alternative embodiment of the upper portion of the marker 20 illustrated in FIG. 1 and houses another embodiment of an anti-chop eye system. The upper portion of the marker 20 illustrated in FIG. 1 is generally disposed above the low-pressure regulator threaded cap 38 and surrounds the bolt assembly 36. The barrel assembly 80 only replaces the upper portion of the marker 20 illustrated FIG. 1. Accordingly, the body 26 illustrated in FIG. 1 may include the barrel assembly 80 illustrated in FIG. 12 along with the other components of the marker 20 illustrated in FIG. 1. For example, the front of the barrel assembly 80 receives the barrel 22 illustrated in FIG. 1.

The barrel assembly 80 is illustrated separately from a marker 20 but is preferably part of a unitary body 26 of the marker 20. Throughout the remainder of the detailed description like elements between the illustrated embodiments are referenced with like numerals with an "a" suffix designating the embodiment illustrated in FIGS. 12 through 17. Additionally, the detailed description of the elements of the pneumatic paintball marker 20 described above applies equally to the similar elements of the barrel assembly 80 illustrated in FIGS. 12 through 17, unless noted otherwise.

The barrel assembly 80 shown in FIG. 12 includes a housing 81 and an insert 82. Within the insert 82 is a moving member or bolt 56*a* that is the same as the bolt 56 described above. The moving member or bolt 56*a* reciprocates within the insert 82 generally along the longitudinal axis of the insert 82 and between forward and back positions.

The insert 82 includes a breech member 84 and a barrel member 86. At least a portion of the breech member 84 is at least translucent, and preferably transparent, so as to allow the light beam of the anti-chop eye system to pass through the breech member 84. In the illustrated embodiment, the entire breech member 84 is transparent. However, only the portions of the breech member 84 that are aligned with the light beam of the anti-chop eye system need be at least translucent.

The handgrip frame 24 of the embodiment illustrated in FIG. 1 preferably houses the electronics for the anti-chop eye system illustrated in FIGS. 12 through 17.

Figure 13:
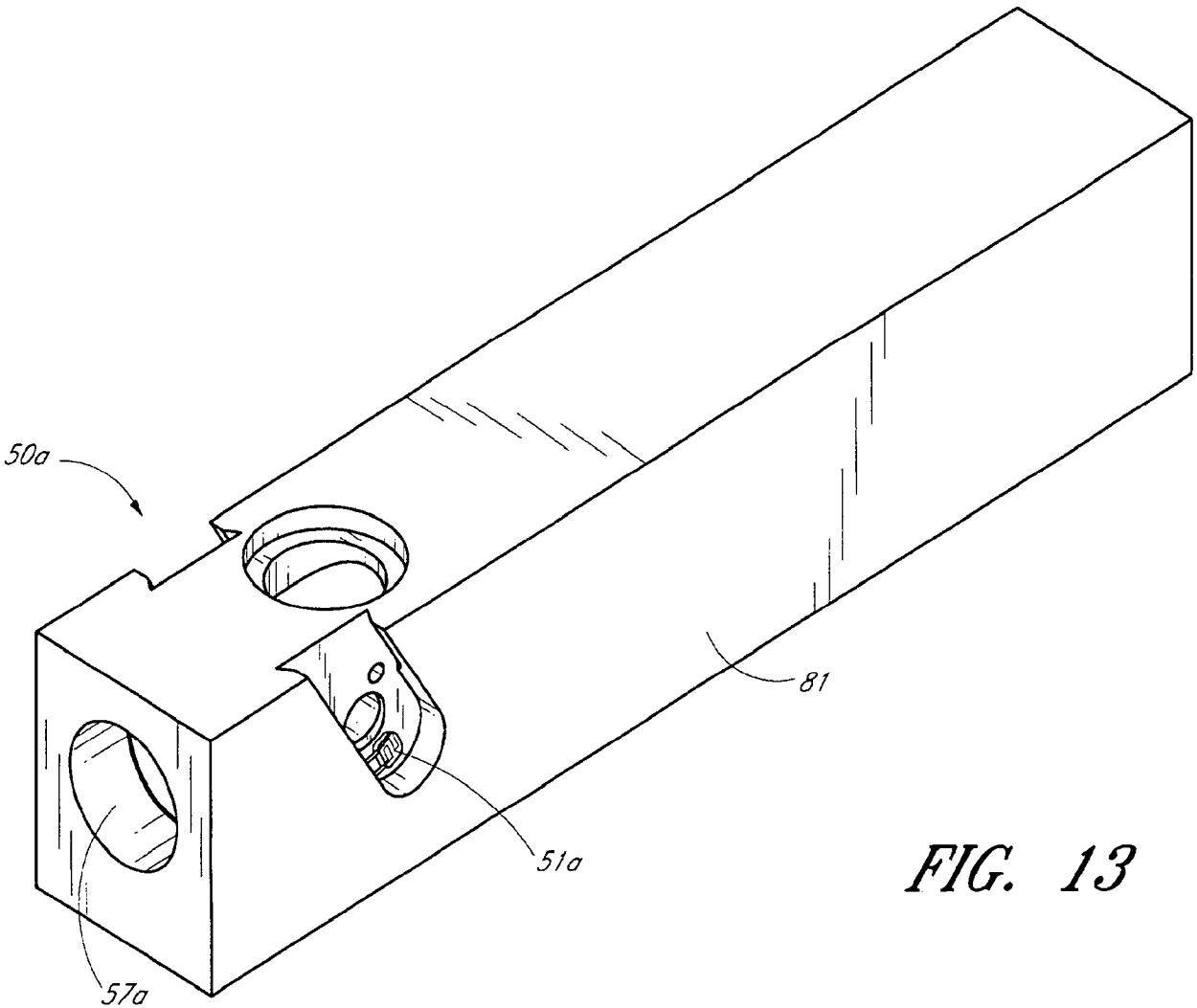
FIG. 13 is a perspective view of the housing from FIG. 12 with the cover plates removed.

FIG. 13 is a perspective view of the housing 81 from FIG. 12 with the cover plates 34*a* removed. The removable cover plates 34*a* on either side of the housing 81 allow a user to access the anti-chop eye system. A receiver 51*a* and a transmitter 50*a* are disposed below the eye covers 34*a*. The anti-chop eye system is installed within the housing 81 by removing the cover plates 34*a*. A user removes the left and right cover plates 34*a* to access components of the anti-chop eye system if necessary. Instead of being located on both sides of the housing 81, the anti-chop eye system may be located on a single side of the housing 81. In such an embodiment, a beam of light transmitted from a first side can be reflected back to the same side to indicate that a paintball is properly positioned within the breech 57*a* prior to firing.

Figure 14:
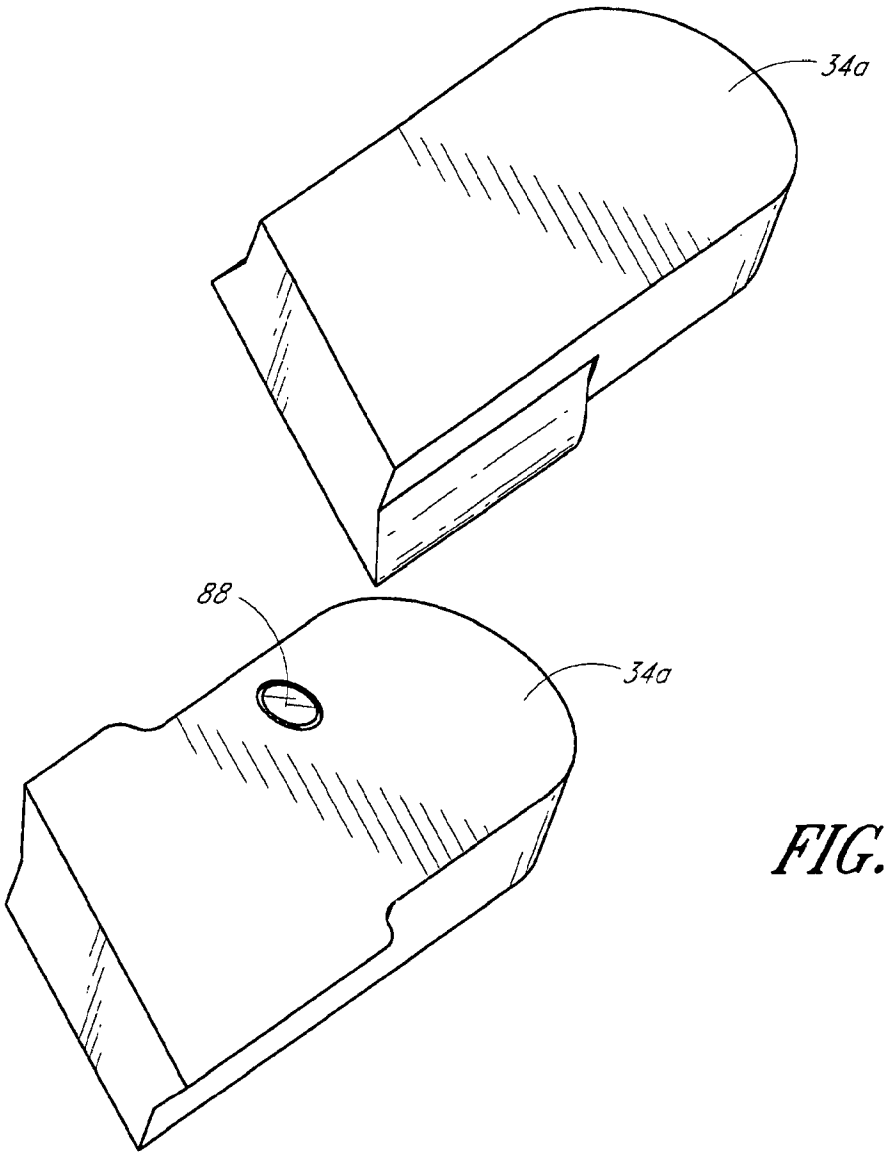
FIG. 14 is a perspective view of the cover plates from FIG. 12 which slidingly engage the housing of the barrel assembly from FIG. 12.
Figure 15:
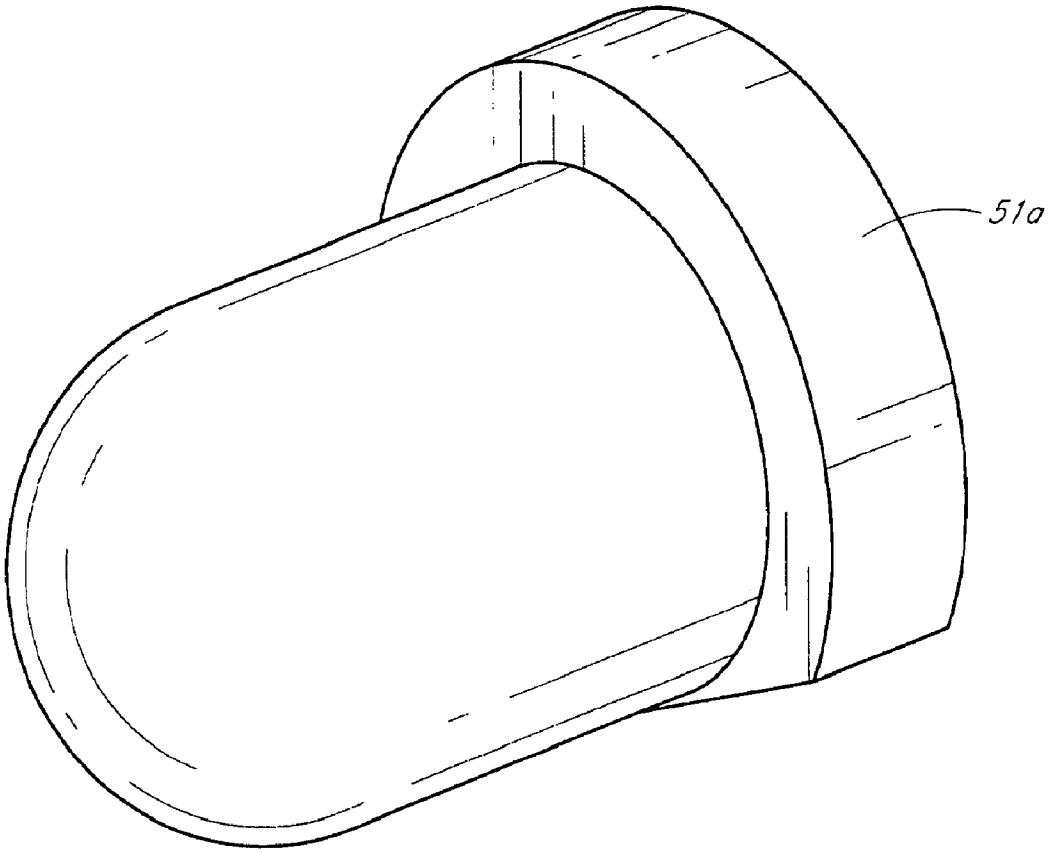
FIG. 15 is a perspective view of a ball detent which protrudes into the breech.

FIG. 14 is a perspective view of the cover plates 34*a* from FIG. 12 which slidingly engage the housing 81 of the barrel assembly 80 from FIG. 12. The ball detent 53*a* contacts a portion 88 of the inside of the cover plates 34*a*. FIG. 15 is a perspective view of the receiver 51*a* of the anti-chop eye system from FIG. 13. The transmitter 50*a* and receiver 51*a* are disposed within the housing 81 but do not extend into the breech 57*a*.

Figure 16:
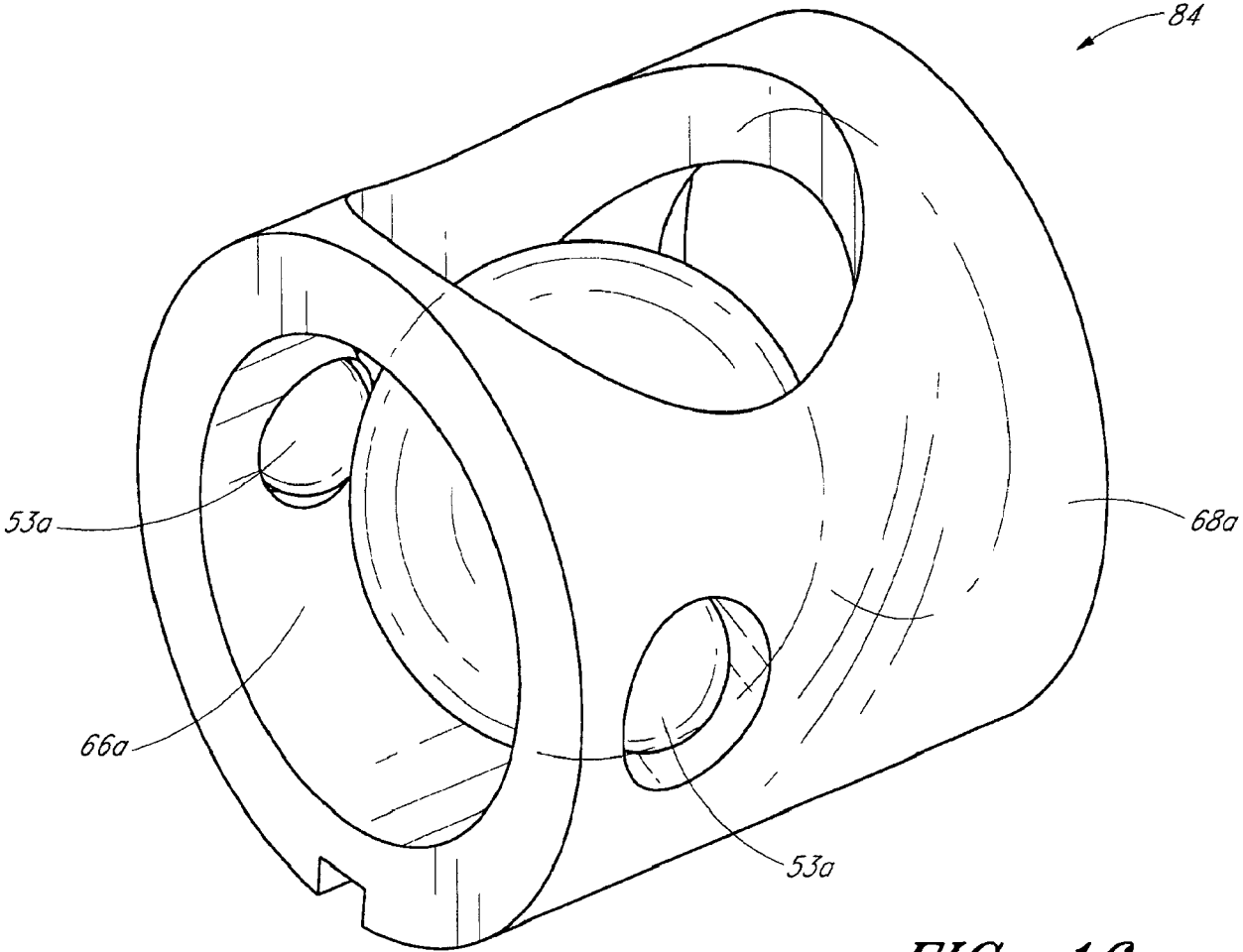
FIG. 16 is a perspective view of a breech member of the insert from FIG. 12.

FIG. 16 is a perspective view of the breech member 84 of the insert 82 from FIG. 12. The anti-chop eye system illustrated in FIGS. 12 through 17 is similar to the anti-chop eye system illustrated in FIGS. 1 through 11 except that the first and second lenses 52, 54 are replaced by the translucent or transparent breech member 84. The outer surface 68*a* of the breech member 84 is similar to the inner surfaces 68 of the first and second lenses 52, 54 illustrated in FIG. 6. The inner surface 66*a* of the breech member 84 is similar to the outer surfaces 66 of the first and second lenses 52, 54 illustrated in FIG. 6. In this way, the transmitter 50*a* transmits the light beam from the housing 81 and toward the outer surface 68*a*. The light beam enters the breech member 84 and exits through the inner surface 66*a* before entering the breech 57*a*. The light beam crosses the breech 57*a* and passes through the breech member 84 before exiting through the outer surface 68*a*. The light beam is then received by the receiver 51*a*.

The inner surface 66*a* of the breech member 84 facing the breech 57*a* is curved to form a longitudinal bore to receive the paintball. Preferably the outer surface 68*a* of the breech member 84 through which the beam passes has a surface contour that substantially matches the inner surface 66*a* of the breech member 84 so that the path of the light beam entering outer surface of the breech member 84 is substantially parallel to the path of the light exiting the inner surface 66*a*. With complementary shapes, the refraction of the light as the light passes through the first boundary of the breech member 84 is cancelled by the refraction caused by the light passing through the second boundary of the breech member 84. Similarly, with complementary shapes, the refraction of the light as the light re-enters the breech member 84 through the inner surface 66*a* is cancelled by the refraction caused by the light exiting the breech member 84 through the outer surface 68*a*.

As explained above, it is also preferred that the inner surface 66*a* substantially match the contour of the bolt 56*a* so as to facilitate the cleaning of the outer surfaces 66. For example, the inner surface 66*a* of the breech member 84 and the moving member or bolt 56*a* may have corresponding curved surfaces. In this way, the corresponding surface of the moving member or bolt 56*a* will contact the corresponding inner surface 66*a* of the breech member 84 and remove enough dirt or other contaminants from at least a portion of the inner surface 66*a* of the breech member 84 to maintain operation of the anti-chop eye system. With the curvature of the inner surface 66*a* of the breech member 84 substantially matching the outer surface of the bolt 56*a*, a more complete wiping or cleaning of the inner surface 66*a* may be achieved.

The translucent or transparent wall of the breech member 84 allows light to pass from the transmitter 50*a*, through the wall, and into the breech 57*a*. In embodiments having a receiver 51*a* located separately from the transmitter 50*a*, the receiver 51*a* may be disposed behind another translucent or transparent wall portion of the breech member 84 so as to receive the transmitted signal at least when the paintball is not positioned in the path of the light beam between the transmitter 50*a* and the receiver 51*a*. In embodiments having a receiver 51*a* disposed near to the transmitter 50*a* or integral with the transmitter 50*a*, the breech wall need only be translucent or transparent in the region where light passes or is reflected through the breech wall.

As with the embodiment illustrated in FIG. 1, the anti-chop eye electronics will inhibit the pneumatic paintball marker from breaking the paintballs within the marker by not allowing the pneumatic paintball marker to fire until a paintball is fully seated in the breech 57*a* in front of the bolt 56*a*.

Figure 17:
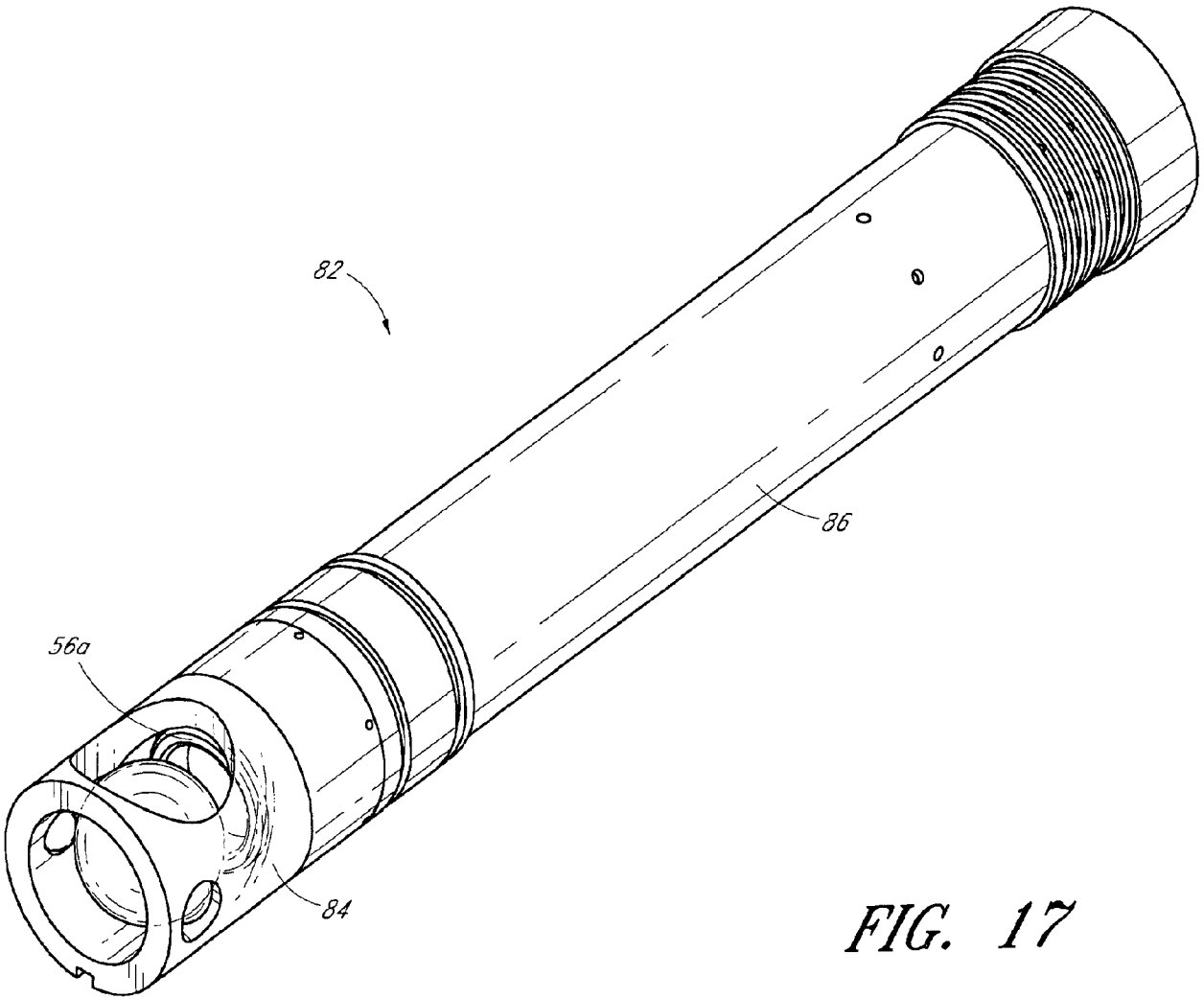
FIG. 17 is a perspective view of the breech member assembled with the barrel member, both from FIG. 12.

FIG. 17 is a perspective view of the assembled insert 82 from FIG. 12. The insert 82 is inserted into the housing 81 so that the breech member 84 is disposed near the end of the housing 81 that receives the paintball.

The anti-chop eye electronic system may also comprise an error reporting system that alerts the user of a malfunctioning of the anti-chop eye electronic system, thereby enabling the user to bypass that system. A second button may also be positioned next to the on-off button on frame, to enable the user to by-pass the anti-chop eye electronic system by pressing that second button. A light signal may also alert the user when the anti-chop eye electronic system is on or off.

Although this invention has been disclosed in the context of a certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A pneumatic marker comprising:

a body member having a breech defining a longitudinal bore, the longitudinal bore having a central axis, the breech having a hole;

a transmitter having an outer surface, the transmitter configured to emit a signal through the outer surface; and a lens disposed in the hole in the breech and being positioned below the central axis to receive the signal after the signal exits through the outer surface of the transmitter, the lens having at least a first surface and a second surface, the signal passing through the first and second surfaces and into the bore so as to sense a paintball within the bore, at least a portion of one of the first and second surfaces being adjacent to the bore and substantially matching a radius of the bore, at least a portion of each of the first and second surfaces having complementary curved contours so that a path of the signal entering the lens is substantially parallel to a path of the signal exiting the lens.

2. The pneumatic marker according to claim 1, wherein the signal is interrupted when the paintball is positioned in the bore.

3. The pneumatic marker according to claim 1, wherein the signal is a reflected signal and the signal is interrupted when the paintball is not positioned in the bore.

4. The pneumatic marker according to claim 1, wherein the signal is modulated, and wherein the marker is programmed to distinguish the modulated signal from an interfering signal.

5. The pneumatic marker according to claim 1, wherein the transmitter focuses the signal prior to the signal entering the first surface.

6. The pneumatic marker according to claim 1 further comprising a receiver receiving the transmitted signal through the first surface.

7. The pneumatic marker according to claim 1 further comprising a moving member disposed in the bore.

8. The pneumatic marker according to claim 7, wherein the moving member is a bolt.

9. The pneumatic marker according to claim 1 further comprising an elongated member and a protrusion, the protrusion extending in a radial direction from the elongated member and circumscribing at least a portion of the elongated member so as to contact at least a portion of the first surface when the elongated member moves from a first position to a second position.

10. The pneumatic marker according to claim 9, wherein the protrusion contacts at least a portion of the second surface when the elongated member moves from the first position to the second position.

11. The pneumatic marker according to claim 9, wherein the protrusion is disposed around the entire circumference of the elongated member.

12. The pneumatic marker according to claim 1, wherein the lens has approximately zero optical power.

13. A pneumatic marker comprising:

a body member having a breech defining a longitudinal bore, the longitudinal bore having a central axis, the breech having a hole;

a transmitter having an outer surface, the transmitter configured to emit a signal through the outer surface; and a first lens disposed in the hole in the breech below the central axis and between the transmitter and the longitudinal bore to receive the signal after the signal exits through the outer surface of the transmitter, the first lens including an inner surface and an outer surface, at least a portion of the inner surface having a curved shape that generally matches at least a portion of the outer surface and a radius of the bore.

14. The pneumatic marker according to claim 13 further comprising:

a receiver; and a second lens disposed between the receiver and the longitudinal bore.

15. The pneumatic marker according to claim 14 further comprising a bolt disposed in the bore and having a locally raised surface, the raised surface extending around at least a portion of the bolt so as to contact at least a portion of at least one of the first and second lenses when the bolt moves from a first position to a second position.

16. The pneumatic marker according to claim 14, wherein the first lens and the second lens are disposed on opposite sides of the bore.

17. An anti-chop eye system for a pneumatic marker, comprising:

a breech member having a longitudinal bore, a hole, and a lens disposed in the hole in the breech member, the longitudinal bore defining a central axis, the lens being disposed below the central axis and having an inner surface and an outer surface, at least a portion of the inner surface having a curved shape that generally matches at least a portion of the outer surface and a radius of the bore;

a transmitter having an outer surface and being configured to transmit light through the outer surface and then into the inner and outer surfaces of the lens; and a receiver configured to receive at least a portion of the light transmitted through the inner and outer surfaces of the breech member.

18. The anti-chop eye system according to claim 17 further comprising a bolt disposed in the bore and having an outer circumference.

19. The pneumatic marker according to claim 18 further comprising an o-ring circumscribing the bolt and having an outer surface that extends beyond the outer circumference of the bolt so as to contact at least a portion of the inner surface of the breech member when the bolt moves from a first position to a second position.

20. The anti-chop eye system according to claim 17, wherein the breech member is translucent.

21. The anti-chop eye system according to claim 17, wherein the breech member is transparent.

* * * * *